United States Patent [19]

Cohen et al.

[11] Patent Number: 4,991,980

[45] Date of Patent: Feb. 12, 1991

[54] BAG WITH AUXILIARY POCKET AND VIEWING WINDOW

[75] Inventors: Alden M. Cohen, Evanston; Mark Faltynek, Chicago; Ronald Marsik, Willow Springs, all of Ill.; David A. Riseman, Waban, Mass.

[73] Assignee: Bagcraft Corporation of America, Chicago, Ill.

[21] Appl. No.: 390,823

[22] Filed: Aug. 8, 1989

[51] Int. Cl.[5] ..... B65D 30/22; B65D 33/04

[52] U.S. Cl. ..... 383/40; 383/104; 383/106; 383/120; 229/71; 229/72

[58] Field of Search ..... 383/38, 39, 40, 106, 383/120, 104; 229/70, 71, 72

[56] References Cited

U.S. PATENT DOCUMENTS

| | | | |
|---|---|---|---|
| Re. 24,962 | 4/1961 | Loderhose . | |
| 1,390,718 | 9/1921 | Lover | 383/40 |
| 1,738,802 | 12/1929 | Stanley | 383/40 X |
| 1,857,010 | 5/1932 | Avery . | |
| 1,955,563 | 4/1934 | Rosenfeld | 383/38 |
| 1,975,404 | 10/1934 | Prucha | 383/40 |
| 2,047,745 | 7/1936 | Poppe | 383/38 |
| 2,073,476 | 3/1937 | Grant et al. . | |
| 2,142,470 | 1/1939 | Claff . | |
| 2,330,015 | 9/1943 | Stokes | 383/109 |
| 2,344,369 | 3/1944 | Salfisberg | 383/106 X |
| 2,502,481 | 4/1950 | Roper . | |
| 2,518,711 | 8/1950 | Mulford . | |
| 2,654,527 | 10/1953 | Geckler et al. | 383/40 |
| 2,867,372 | 1/1959 | Fox | 383/40 X |
| 2,917,164 | 12/1959 | Kehr | 383/40 X |
| 2,931,557 | 4/1960 | Loderhose . | |
| 3,110,121 | 11/1963 | Corrinet . | |
| 3,254,824 | 6/1966 | Lang . | |
| 3,314,592 | 4/1967 | Streich . | |
| 3,315,878 | 4/1967 | Hiersteiner | 229/72 |
| 3,522,908 | 8/1970 | Carrigan | 229/71 X |
| 3,695,422 | 10/1972 | Tripodi . | |
| 3,762,628 | 10/1973 | Sargent | 383/40 |
| 3,856,198 | 12/1974 | Daley | 229/72 X |
| 3,958,744 | 5/1976 | Herglotz . | |
| 4,129,214 | 12/1978 | Gendron . | |
| 4,204,600 | 5/1980 | Pritchard | 229/71 X |
| 4,308,679 | 1/1982 | Ray, III, et al. . | |

FOREIGN PATENT DOCUMENTS

| | | | |
|---|---|---|---|
| 0174674A2 | 3/1986 | European Pat. Off. . | |
| 859559 | 12/1952 | Fed. Rep. of Germany | 383/40 |
| 3716556 | 11/1987 | Fed. Rep. of Germany | 383/38 |
| 2435401 | 5/1980 | France | 383/40 |
| 300103 | 11/1928 | United Kingdom . | |
| 383281 | 10/1932 | United Kingdom . | |
| 494010 | 10/1938 | United Kingdom . | |
| 1149044 | 4/1969 | United Kingdom . | |
| 2211079A | 6/1989 | United Kingdom . | |

*Primary Examiner*—Stephen Marcus
*Assistant Examiner*—Jes F. Pascua

[57] ABSTRACT

There is disclosed herein a bag which is constructed to form a primary loading compartment and an auxiliary load-carrying or promotional-item-carrying pocket. The bag includes front, back, side and bottom panels and a compartment forming partition panel. The partition panel is secured to the front panel so as to define primary and auxiliary load-carrying compartments. The auxiliary compartment is formed by the front panel and partition panel. The front panel may be apertured and overlaid with a transparent film so as to form a window. The partition is adhered to the front panel so as to form a pocket in which the contents are positioned for viewing through the window.

5 Claims, 1 Drawing Sheet

FIG. 1
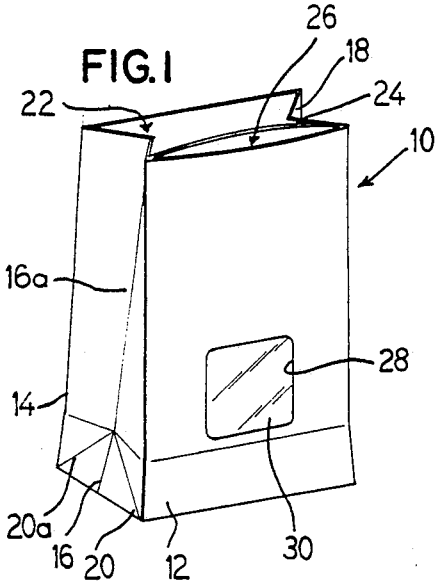
FIG. 2
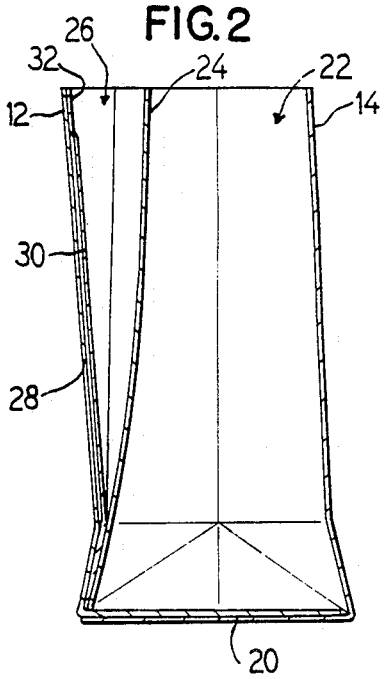
FIG. 3
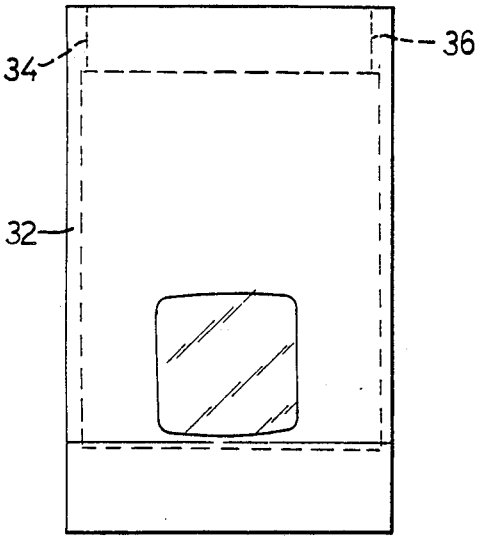
FIG. 4
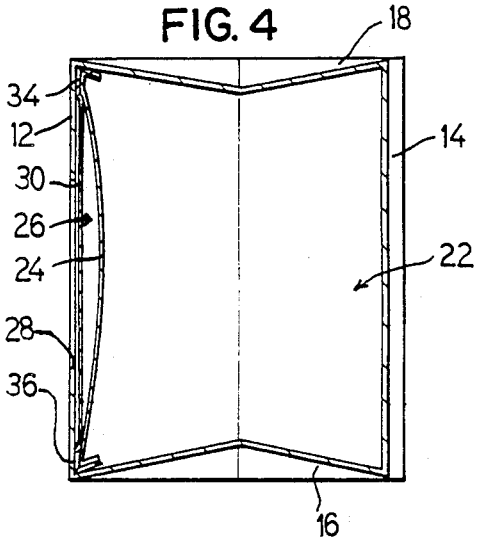
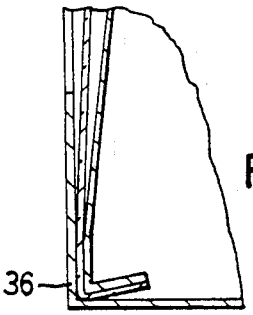
FIG. 5

BAG WITH AUXILIARY POCKET AND VIEWING WINDOW

BACKGROUND OF THE INVENTION

This invention relates to paper bags of the type used to carry consumer products, and more particularly, a bag which is constructed to form an auxiliary or second pocket useful in carrying a second or a pormotional item in addition to the principal item.

Paper bags of the type used to carry consumer goods are well known. These bags are commonly used in markets to carry grocery items and in the retail fast-food trade. These bags are fabricated from a single sheet of peper or a lamination of sheets of paper or plies that are bonded together, glued to form a tube, then severed and folded. The bags thus formed define front, back, side and bottom panels or walls. Such bags have an open top and define a primary product carrying compartment or pocket into which items such as grocery items or fast-food products are loaded. The outer surface of the bag can be printed with various types of indicia. Moreover, if two plies are used, the inner and outer plies can have the same or different properties. For example, the inner ply may be liquid or grease resistant, while the outer ply can be strong and susceptible to printing thereon. Various combinations of properties can be selected, depending upon the use to which the bag is to be put.

Usually bags have only a primary load carrying compartment for carrying a single type of item unless all purchased items are to be carried. It has been found that in selling single items (e.g., fast food items), it is desirable to carry other items, such as promotional items, in the bag preferably separate from the main compartment.

It is therefore an object of this invention to provide a bag which defines a primary goods compartment and an auxiliary or secondary compartment for selective use with promotional items.

These and other objects of this invention will become apparent from the following disclosure and appended claims.

SUMMARY OF THE INVENTION

There is provided by this invention a bag which forms two separate compartments, a primary compartment for the primary items, and an auxiliary or secondary compartment or pocket for dissimilar promotional items. A window section can be provided on the bag in association with the pocket for viewing the promotional item.

A bag is formed using either a single sheet or multiple sheet laminate and a window aperature is cut in the bag's front panel. A transparent film extends across the opening of the front panel so as to cover the aperture and thus form a closed viewing window. A partition is provided within the bag and is secured adjacent the front panel. This partition in cooperation with the front panel forms the secondary pocket for promotional items and separates this pocket from the main compartment of the bag.

BRIEF DESCRIPTION OF THE DRAWINGS

FIG. 1 is a perspective view showing a packet-style bag with a window therein;

FIG. 2 is a vertical section taken along line II—II of FIG. 1 showing the main compartment and the pocket for a pocket-style bag;

FIG. 3 is a front elevational view showing the window formation in a pocket-style bag and glue pattern;

FIG. 4 is a top plan view of a window-type pocket-style bag showing the partition formation; and FIG. 5 is an elarged view showing a corner formation for a window-type pocket-style bag.

DESCRIPTION OF THE PREFERRED EMBODIMENT

Referring first to FIG. 1, there is shown a bag 10 generally which includes a front panel 12, a back panel 14, a pair of side panels 16 and 18, and a bottom panel 20. Each of the side panels includes a center fold line such as 16*a* and the bottom panel can be folded upwardly via the bottom folds 20*a* against the back panel for flat storage of the bag or downwardly for use.

This bag has an open top end and thus defines a primary or main load carrying compartment 22 for carrying items of a single type or of the type that can be mixed together.

The bag also includes a partition 24 that cooperates in forming the auxiliary or secondary compartment 26. The front panel 12 has been cut so as to define a window forming aperture 28.

A transparent sheet or film 30 is secured about its entire periphery to the inside of the front panel and overlies the aperture 28. This sheet cooperates in retaining the items within the secondary compartment and with the aperture 28 defines a closed window. The transparent sheet is adhered to the front panel in the peripheral frame-like pattern 32 as shown in FIG. 2, which is generally defined by the dotted lines.

Referring to FIGS. 2 and 4, the partition panel 24 is provided in the bag adjacent the front panel 12. This partition divides the bag into a main compartment 22 defined by the partition 24, sides 16 and 18, back 14 and bottom 20 and the auxiliary compartment 26 which is adjacent the front panel.

The auxiliary compartment is basically defined by the partition 24 and the front panel 12 and transparent sheet 30. The partition 24 is adhered to the front wall, along the base and two sides, or in other words, in a U-shaped pattern that extends across the base of the front wall below the window and up each side to the top. In a sense the partition pattern overlies the transparent sheet pattern, extends to the top of the bag but does not cross the top. This is suggested by the chain lines 34 and 36 in FIG. 2. This bonding pattern is also seen in FIGS. 4 and 5. The top and remainder of the partition is separable from the front panel for forming the pocket.

In FIGS. 4 and 5, the transparent sheet 30 and partition 24 are shown having side flaps which may or may not be used in commercial applications.

Morevoer, that portion of the pattern for the partition adjacent the viewing window is spaced upwardly from the bottom panel 20 and adjacent the window.

Promotinal items covered in the auxiliary pocket may be small and are to be viewable by a purchaser. Thus the pocket does not extend to the bottom panel but extends only to a position between the window and bottom panel so as to prevent the items from slipping below the window where they could not be viewed. In one particular arrangment the bag and gluing dimensions are as follows:

Bag: $5'' \times 3\frac{1}{2}'' \times 9\frac{3}{4}''$

Window Size: $2\frac{1}{8}'' \times 3\frac{1}{4}''$
Window Position: $1\frac{3}{4}''$ from bottom
Base Glue Line: $1\frac{1}{4}''$ from bottom
Side Glue Lines: $\frac{1}{2}''$ from sides Based on the foregoing, a bag is disclosed which is effective to carry a principal item(s) in a primary compartment and a secondary or promotional item for viewing in a secondary compartment.

Although the invention has been described with respect to preferred embodiments, it is not to be so limited as changes and modifications can be made which are within the full intended scope of the invention as defined by the appended claims.

We claim as our invention:

1. A flexible bag construction wherein the bag includes a front panel; a back panel constructed to be spaced from said front panel; a pair of side panels, each joined to a front and back panel; a bottom panel joined to each of the front, back and side panels; and an open top for access to the interior of the bag, wherein the improvement comprises said bag having an interior partition panel secured to the bag adjacent the front panel and separable therefrom so as to define a main article-carrying compartment with an open top between said partition panel and back panel and an auxiliary article-carrying compartment with an open top between said partition panel and front panel, said front panel also defining a viewing aperture and there being provided a transparent film adhered to said front panel and covering said aperture so as to define a viewing window through which contents of the auxiliary compartment can be viewed, wherein the partition panel is adhered to the front panel by a glue pattern that defines an adhered area between the aperture and the bottom panel, whereby the auxiliary compartment is shorter than the main compartment and the bottom of the auxiliary compartment is spaced above the bottom of the main compartment.

2. A bag as in claim 1, wherein said bottom panel is constructed for opening to a position at about right angles to the front, back and side panels and to rest on a flat surface and cooperate in supporting said panels at an upright attitude, whereby said bag is useful in a retail environment.

3. A bag as in claim 1, wherein said transparent film is a web adhesively secured to said front panel.

4. A bag as in claim 1, wherein said partition panel is a web adhesively secured to said front panel along the side edges thereof and along a glue line transverse to the side edges and between the aperture and the bottom panel.

5. A bag construction wherein the bag includes a front panel; a back panel constructed to be spaced from said front panel; a pair of said panels, each joined to a front and back panel; a bottom panel joined to each of the front, back and side panels; and an open top for access to the interior of the bag, wherein the improvement comprises said bag having an interior partition panel secured to the bag adjacent the front panel and separable therefrom so as to define a main article-carrying compartment with an open top between said partition panel and back panel and an auxiliary article-carrying compartment with an open top between said partition panel and front panel, said front panel also defining a viewing aperture and there being provided a transparent film adhered to said front panel and covering said aperture so as to define a viewing window through which contents of the auxiliary compartment can be viewed; wherein said bottom panel is constructed for opening to a position at about right angles to the front, back and side panels and to rest on a flat surface and cooperate in supporting said panels at an upright attitude, whereby said bag is useful in retail environment; wherein said transparent film is a web adhesively secured to said front panel; and wherein said partition panel is a web adhesively secured to said front panel along the side edges thereof and along a glue line transverse to the side edges and between the aperture and the bottom panel.

* * * * *